US006805461B2

(12) United States Patent
Witte

(10) Patent No.: US 6,805,461 B2
(45) Date of Patent: Oct. 19, 2004

(54) FLASHLIGHT

(75) Inventor: Waldemar Witte, Murrhardt Wurtt (DE)

(73) Assignee: Witte + Sutor GmbH, Murrhardt (DE)

( * ) Notice: Subject to any disclaimer, the term of this patent is extended or adjusted under 35 U.S.C. 154(b) by 0 days.

(21) Appl. No.: 10/353,114

(22) Filed: Jan. 28, 2003

(65) Prior Publication Data

US 2003/0174497 A1 Sep. 18, 2003

(30) Foreign Application Priority Data

Jan. 28, 2002 (DE) ..... 202 01 267 U

(51) Int. Cl.[7] ..... F21V 5/04

(52) U.S. Cl. ..... 362/169; 362/183; 362/184; 362/202

(58) Field of Search ..... 362/169, 171, 362/183, 184, 199, 200, 202, 205, 208, 800

(56) References Cited

U.S. PATENT DOCUMENTS 3,711,703 A * 1/1973 Bacevius ..... 362/189
4,514,790 A * 4/1985 Will ..... 362/183
6,168,288 B1 * 1/2001 St. Claire ..... 362/184
6,239,555 B1 * 5/2001 Rachwal ..... 315/200 R
6,357,893 B1 * 3/2002 Belliveau ..... 362/285
6,485,160 B1 * 11/2002 Sommers et al. ..... 362/184
2002/0093818 A1 * 7/2002 Mele ..... 362/203
2003/0117797 A1 * 6/2003 Sommers et al. ..... 362/237
2003/0123254 A1 * 7/2003 Brass et al. ..... 362/231

* cited by examiner

*Primary Examiner*—Thomas M. Sember
*Assistant Examiner*—Hargobind S. Sawhney
(74) *Attorney, Agent, or Firm*—Collard & Roe, P.C.

(57) ABSTRACT

A flashlight having at least one shaft piece for enclosing at least one battery as the voltage supply, and having at least one flashlight head (2) enclosing a plurality of white LED's (14) as illuminants. The flashlight head is connected to the shaft piece (3), and has an electrical connector coupled to the illuminants, and a connector piece (17) for connection to the battery. The connector piece (17) corresponds substantially with a flashlight bulb socket, wherein the connector piece (17) having a coaxial ring electrode (21), disposed radially on the outer side and connected with the ground pole, and a pin electrode (20) disposed concentrically on the inner side for connection with the battery of the flashlight.

11 Claims, 2 Drawing Sheets

FLASHLIGHT

This invention relates to a flashlight in which light-emitting diodes (LED's) are used as illuminants.

BACKGROUND OF THE INVENTION

Due to the development of blue light-emitting diodes, it has now become possible to also develop white light-emitting diodes. The robustness and low energy consumption of white LED's via-a-vis conventional incandescent light sources have led to the increased application of white or blue LED's in flashlights. In this connection, such LED's usually have different outside dimensions and connection designs than the conventional flashlight bulbs commonly in use. Thus, new casings usually have to be developed for using white LED's, and moreover, the customer may have to purchase a new flashlight.

Therefore, the present invention provides a flashlight that can be equipped at a later time with LED's as the illuminant means, or to use conventional illuminants, if necessary, or the novel LED's.

Due to the fact that a connector piece is interconnected between the illuminant and the voltage supply in conjunction with a white LED that substantially corresponds to flashlight bulb socket, a novel adapter element has been developed that permits using a flashlight head with integrated LED's in conjunction with a shaft piece of the type used in association with conventional illuminants. The batteries, which are usually connected with such a shaft piece in a non-detachable manner, therefore can be used also in the future in connection with the novel type of illuminant. If a completely new flashlight is purchased, it is possible for the customer to continue to use as a replacement, a battery with any shaft piece that he may already have.

A connector piece is provided in the head of the flashlight, which represents an advantageous further development of the invention. This connector piece is substantially comprised of a coaxial ring electrode having a structure that substantially corresponds with a conventional flashlight socket.

This connector piece is connected with the one or more illuminants via a small conductor board that is comprised of two electrically insulated areas. The advantage of such a flat conductor board is that several illuminants can be connected in parallel at the same time.

In another advantageous development of the invention, several white LED's that are concentrically arranged in relation to an imaginary central axis, are integrated in the head of the flashlight.

The white LED's are secured on an illuminant carrier. The LED's are ideally cast directly together with this platform for supporting the illuminants, resulting in a strong element for retaining the illuminants that is by far superior to conventional flashlight sockets with respect to its durability and reliability.

On the side facing away from the shaft piece, the head of the illuminant is terminated by a transparent cover preferably made of plexiglas. This termination prevents foreign material from penetrating the head of the flashlight and thus contributes to the enhanced durability of the flashlight, particularly under difficult environmental conditions.

As a further development of the invention, biconvex lenses are shaped in the transparent plexiglas cover. The number of lenses preferably corresponds in this connection with the number of LED's integrated in the head of the flashlight. The lenses are inclined toward one another in the sense of a focusing effect, so that the axes of the light beams of the lenses are focused. The inclination of the lenses is ideally selected depending upon the spacing of the illuminants from the lenses or the focal plane of the latter.

A preferably multi-cell nickel-metal-hydride battery for supplying the illuminants with current is preferably integrated within the casing of the shaft. These nickel-metal-hydride batteries have been found to be robust and permanently durable when they are preferably applied in the present case, if they are frequently recharged.

To recharge the batteries in the casing of the shaft, a charging plug is located on the surface of the shaft casing facing away from head of the flashlight. The batteries can be charged via conventional household plug sockets by means of the plug contact arranged on this side.

The charging plug can be sealed with a closing cap. This closing cap prevents the contacts of the plug from getting damaged, and improves the way in which the flashlight can be handled.

The shaft housing of the flashlight has a substantially rectangular cross section with rounded corners, which, in the area of the head of the flashlight, changes without steps into a square cross section. The square shape is particularly advantageous in connection with four white LED's that can be concentrically disposed in a space-saving manner in relation to the central axis of the flashlight.

On the narrow sides of the aforementioned rectangularly-shaped cross section, ribs are provided on the outside surface that leads to an enhanced gripping and feel of the flashlight.

The head of the flashlight is connected in a detachable manner with the casing of the shaft via a interlocking contours.

BRIEF DESCRIPTION OF THE DRAWINGS

Other objects and features of the present invention will become apparent from the following detailed description considered in connection with the accompanying drawing which disclose at least one embodiment of the present invention. It should be understood, however, that the drawing is designed for the purpose of illustration only, and not as a definition of the limits of the invention.

In the drawing, wherein similar reference characters denote similar elements throughout the several views.

DETAILED DESCRIPTION

Figure 1:
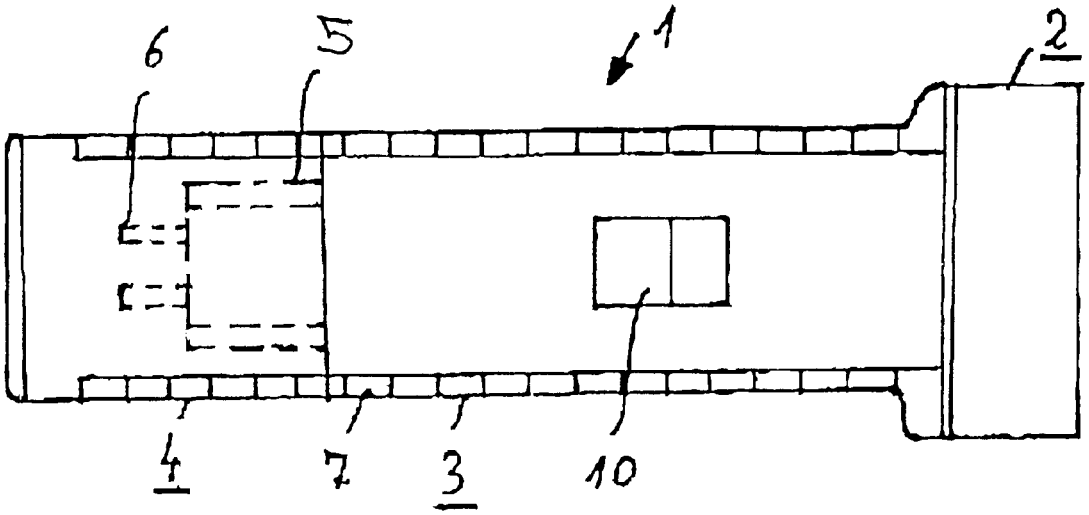
FIG. 1 is a side view of a flashlight.
Figure 3:
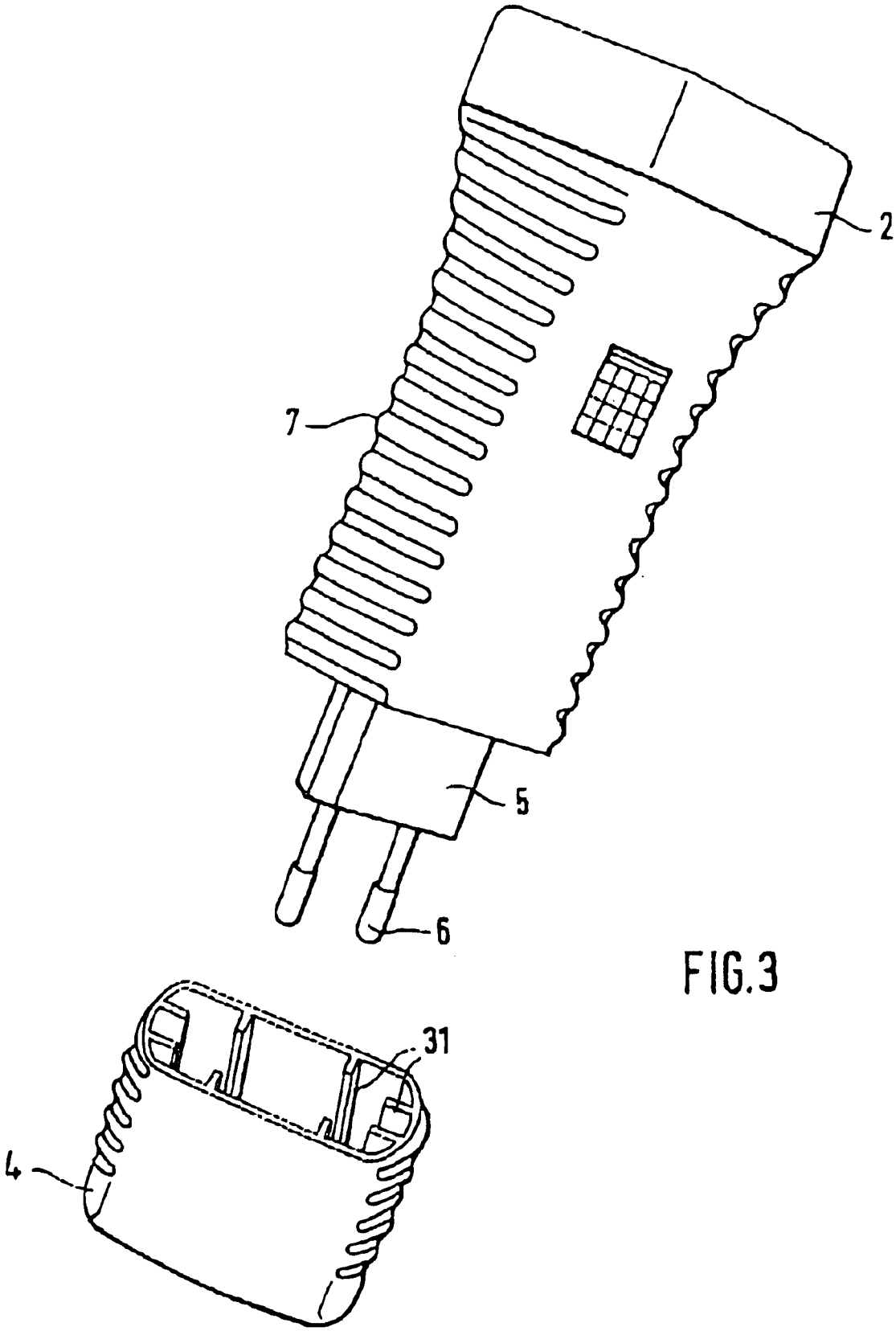
FIG. 3 is a perspective view of the flashlight of FIG. 1.

Referring to FIGS. 1 and 3, there is shown a flashlight 1 that can be substantially divided into three sections, which include the head 2 and the shaft piece 3 adjoining the head. On the side facing away from the head 2 of the flashlight, the shaft piece terminates in a closing cap 4. Closing cap 4 covers a charging plug 5, which is directly adjoining shaft piece 3, and serves for charging a nickel-metal-hydride battery 30 for supplying an illuminant, received in the flashlight head 2, with voltage.

The nickel-metal-hydride battery is preferably a four-cell accumulator that supplies an operating voltage of 4.8 volts.

For the purpose of forming a clamped fit, closing cap 4 has an internal rib 31 shown in FIG. 3 so that it can be easily plugged onto charging plug 5, and pulled off again.

Shaft piece 3 and closing cap 4 preferably have a substantially rectangular cross section with rounded corners. On the outer side, a rib or profile 7 is arranged on each one of the two narrow sides of the rectangular cross section for the purpose of creating an enhanced haptics or gripping for the flashlight 1. The outside rib 7 extends all the way through closing cap 4 and across shaft piece 3.

As shown in FIG. 3, within the area of head 2 of the flashlight, the cross section of flashlight 1 changes into a substantially square cross section, so that head 2 of the flashlight is widened on at least two sides versus the remaining part of shaft piece 3.

Figure 2:
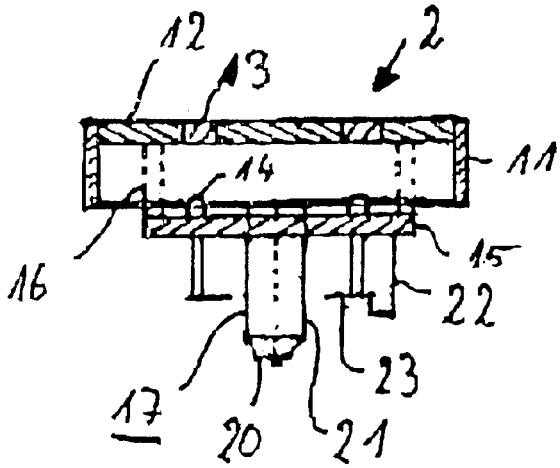
FIG. 2 is a cross sectional view taken through the head of the flashlight.

FIG. 2 shows on the inner side, in the area adjoining shaft piece 3, an enclosure 11 of flashlight head 2, provided with an interlocking contour 32, or with corresponding undercuts 33 that can be interlocked with locking naps or flanges of shaft piece 3 in a defined end position.

In the center of the broad side of shaft piece 3, there is provided a sliding switch 10 for turning on or off the illuminants, arranged in flashlight head 2. In the manner known per se, it is possible also to realize a blinking light by just momentarily tipping the sliding switch. Switch 10 is otherwise locked in its respective ON/OFF positions. Switch 10 couples to corresponding contacts that connect one pole of the battery to one contact of the illuminants.

Referring to the sectional representation and detailed view of FIG. 2, which is not true to scale, flashlight head 2 is substantially comprised of a plastic enclosure 11, which, on the surface pointing away from the shaft piece, frames a transparent plexiglas cover 12.

Moreover, biconvex lenses 13 are molded into transparent cover 12. Biconvex lenses 13 are set at an angle vis-a-vis the plane formed by the surface of the transparent plexiglas cover 12 so that the pencils of light rays radiating through lenses 13 are united in a central point of illumination at a defined distance in front of cover 12. The number of lenses 13 corresponds in this connection with the number of the illuminants integrated in the head of the flashlight.

In this embodiment, white LED's 14 are arranged as illuminants in flashlight head 2. Instead of using white LED's 14, it is also possible to use LED's 14 with another color spectrum, such as blue. LED's 14 are secured on an illuminant carrier 15. This carrier is a circular disk of plexiglas that is fastened with a defined spacing from transparent cover 2 via spacers 16.

Spacers 16 are also made of plexiglas so that transparent cover 12 including illuminant carrier 15 and spacers 16 can be manufactured in the form of a single piece. In this production step, LED's 14 are preferably cast jointly with the illuminant carrier 15, and thus combined with the latter in a fixed manner. This provides a decidedly strong and almost indestructible fastening of LED's 14 that is by far superior to conventional flashlight sockets.

In the present embodiment, illuminant carrier 15 supports the four white LED's 14 in an imaginary peripheral circle, concentrically disposed around the central axis of flashlight 1. Lenses 13 are each arranged in the path of radiation of the LED's 14, with the result that the number of lenses 13 corresponds with the number of LED's 14 used. The spacing of illuminant carrier 15 or LED's 14 from lenses 13 is in a predetermined relation to the angle of inclination of lenses 13 or their axes of radiation versus the surface plane of transparent cover 12. In the present embodiment, the lenses are set or inclined with respect to one another at an angle of about 2 degrees versus the surface plane of transparent cover 12.

Radially on the inside, the illuminant carrier is enclosing a connector piece 17 that is jointly cast together with the illuminant carrier as well. This connector piece is substantially comprised of a ring electrode arrangement consisting of a central pin electrode 20, and a coaxial ring electrode 21.

Connector piece 17 is constructed to substantially correspond with a conventional lamp socket such as, for example the socket of a halogen lamp, of the type usually employed in flashlights 1. Due to the structure of connector piece 17, it is possible to use flashlight head 2 with LED's 14, in conjunction with a shaft piece 3 and its integrated battery that has been employed until now in a conventional flashlight socket. The novel type of flashlight head 2 with integrated LED's 14 therefore can be also fitted at a later time with existing shaft pieces 3, or shaft pieces 3 already available can be used as replacement accumulators for the novel type of a flashlight head 2. This is advantageous particularly since the useful life of the white LED's and their radiation intensity are by far superior to the halogen flashlights presently in use.

Another benefit is the lower energy requirement of the white LED's vis-a-vis conventional halogen flashlights.

A pin electrode 20 is connected with a connection contact to the voltage supply disposed in shaft piece 3. A ring electrode 21 of connector piece 3 forms the ground pole of the electrode arrangement. Beneath the illuminant carrier 15, there is provided a small conductor board 23 for connecting LED's 14 in parallel. This small conductor board is retained by a fastening piece 22. Small conductor board 23 is a four-cornered conductor board with a piped structure on the inside, which is arranged below the illuminant carrier 15 and spaced apart from connector piece 3. The small conductor board 23 is comprised of two electrically insulated areas, of which the one area is electrically conductively connected with pin electrode 20, and the other area with ring electrode 21.

The contacts of LED's 14 are connected to small conductor board 23, whereby one contact is connected in each case to the voltage, and the other to ground.

As mentioned before, due to the structure of connector piece 3, flashlight head 2 described above can be readily connected with a conventional shaft piece 3. Therefore, the above text describes a flashlight 1 with a flashlight head 2 for equipping existing shaft pieces 3 therewith at a later time. Flashlight 1 thus has a lower energy requirement combined with a higher light yield.

Accordingly, while at least one embodiment of the present invention has been shown and described, it is to be understood that many changes and modifications may be made thereunto without departing from the spirit and scope of the invention as defined in the appended claims.

What is claimed is:

1. A flashlight having at least one shaft piece with a bulb socket, and for enclosing at least one battery as the voltage supply, comprising;

at least one flashlight head enclosing a plurality of white LED's arranged concentrically with the central axis of the flashlight as illuminants, connected to an electrically nonconductive illuminant carrier, and cast jointly with said carrier in a fixed manner, said flashlight head being connectable with the shaft piece, an electrical connection coupled to said illuminants and having a connector piece for connection to the battery;

wherein said at least one flashlight head is closed by a transparent cover made of plexiglas, disposed on the surface pointing away from the shaft piece, said transparent cover comprising a number of biconvex lenses corresponding with the number of LED's used, said lenses being integrally formed into the transparent cover so that the optical axes of the lenses are inclined with respect to one another and the surface plane of the transparent cover for producing a focused beam of light.

2. The flashlight according to claim 1, wherein said connector piece comprises a coaxial ring electrode, disposed radially on the outer side and connected with the ground pole, and a pin electrode disposed concentrically on the inner side for connection to the battery of the flashlight.

3. The flashlight according to claim 2, wherein the shaft piece includes a switch having contacts for electrically connecting the illuminants to the battery.

4. The flashlight according to claim 1, wherein said ring electrode of said connector piece includes a conductor board electrically connected to said ring electrode, said conductor board concentrically enclosing said ring electrode whereby said conductor board comprises two electrically insulated areas, wherein one area is electrically connected with said ring electrode and the other area with the pin electrode of said connector piece.

5. The flashlight according to claim 1, wherein the angle of inclination of said lenses is selected depending upon the spacing of said lenses from the axis of said transparent cover.

6. The flashlight according to claim 1, wherein the battery disposed in said shaft piece is constructed from four nickel-metal-hydride cells.

7. The flashlight according to claim 6, comprising a charging plug coupled to the shaft piece, and disposed on the side facing away from the flashlight head, for connection to a household electrical socket.

8. The flashlight according to claim 7, comprising a closing cap, detachably secured to the end of said shaft piece, for enclosing said charging plug.

9. The flashlight according to claim 8, wherein the flashlight has a substantially rectangular cross section with rounded corners, and wherein the rectangular cross section of the shaft piece changes in the area of the flashlight head without steps into a square cross section with rounded corners.

10. The flashlight according to claim 9, wherein said shaft piece and said closing cap each are provided with external ribs on their narrow sides.

11. The flashlight according to claim 10, wherein said shaft piece has at least two locking flanges, and said flashlight head is connected in a detachable manner with said shaft piece by means of corresponding interlocking contours, so that when assembled, said at least two locking flanges of the shaft piece interlock with corresponding undercuts of said flashlight head.

* * * * *